US007656267B2

(12) United States Patent
Johnson

(10) Patent No.: US 7,656,267 B2
(45) Date of Patent: Feb. 2, 2010

(54) ELECTRICAL TRANSFORMERS AND ASSEMBLIES

(75) Inventor: Daniel Len Johnson, Kernersville, NC (US)

(73) Assignee: Tyco Electronics Corporation, Middletown, PA (US)

( * ) Notice: Subject to any disclaimer, the term of this patent is extended or adjusted under 35 U.S.C. 154(b) by 190 days.

(21) Appl. No.: 11/116,487

(22) Filed: Apr. 28, 2005

(65) Prior Publication Data

US 2006/0244562 A1 Nov. 2, 2006

(51) Int. Cl.
*H01F 27/24* (2006.01)

(52) U.S. Cl. ..... 336/234

(58) Field of Classification Search ..... 336/211–216, 336/234

See application file for complete search history.

(56) References Cited

U.S. PATENT DOCUMENTS 536,608 A * 4/1895 Dickerson ..... 336/214
577,480 A * 2/1897 Gutmann ..... 336/214
1,297,161 A * 3/1919 Hendricks, Jr. ..... 336/212
2,350,029 A * 5/1944 Glass, Jr. ..... 336/178
3,355,689 A * 11/1967 Paddison et al. ..... 336/234
4,897,916 A 2/1990 Blackburn
5,406,243 A 4/1995 Jenkins et al.
5,424,899 A 6/1995 Scott et al.
5,671,526 A 9/1997 Merlano
6,060,978 A 5/2000 Marquardt
6,218,927 B1 * 4/2001 Segal ..... 336/216
6,765,467 B2 * 7/2004 Ngo et al. ..... 336/67

* cited by examiner

*Primary Examiner*—Tuyen Nguyen

(57) ABSTRACT

The present disclosure relates to electrical transformer assemblies including a first lamination assembly defining a passage therethrough; and a second lamination assembly configured and dimensioned for press-fit or slide-fit engagement in the passage formed in the first lamination assembly. The first lamination assembly includes a stack of laminations each defining a central opening and defining the passage of the first lamination assembly when in a stacked condition. Each lamination of the first lamination assembly defines at least one shaped recess formed in a side edge of the central opening. The second lamination assembly includes a stack of laminations each including at least one shaped tab extending from a side edge thereof, wherein each tab is configured and dimensioned for press-fit or slide-fit engagement in a respective shaped recess formed in the side edges of the passage formed in the first lamination assembly.

20 Claims, 6 Drawing Sheets

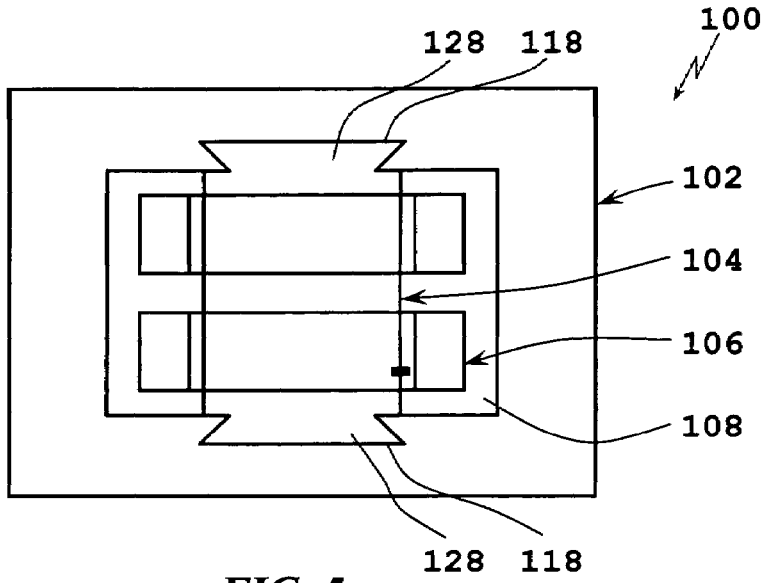
*FIG. 5*
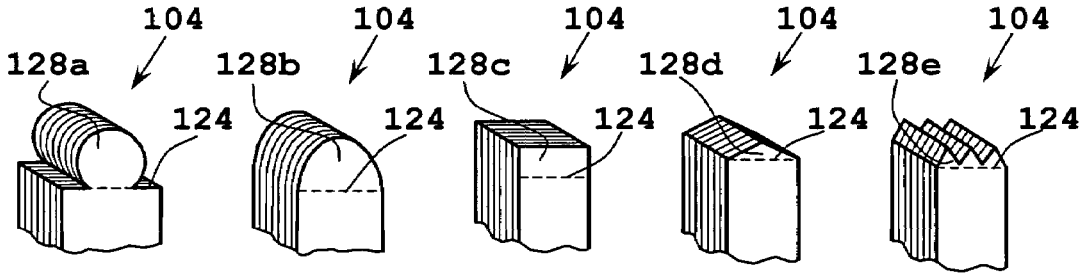
*FIG. 6A* *FIG. 6B* *FIG. 6C* *FIG. 6D* *FIG. 6E*
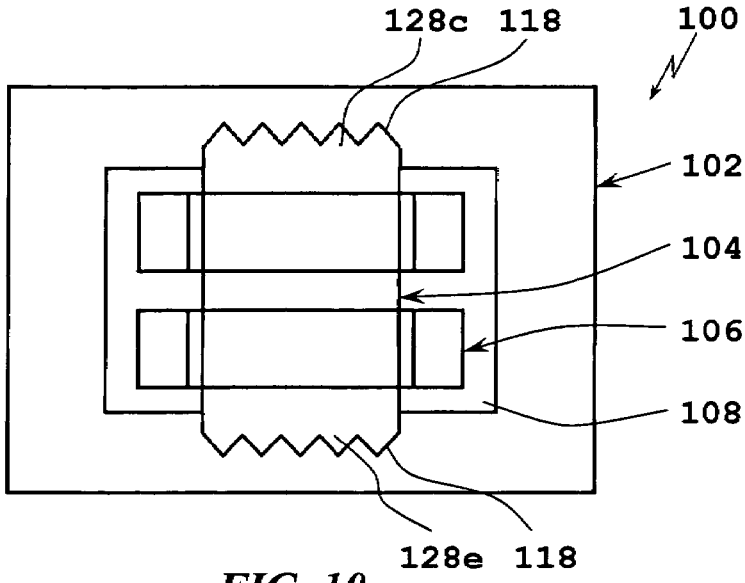
*FIG. 10*

ELECTRICAL TRANSFORMERS AND ASSEMBLIES

BACKGROUND

1. Technical Field

The present disclosure relates to electrical transformers, and more particularly, to compact electrical transformers exhibiting a greater degree of efficiency as compared with current electrical transformers and assemblies including the same.

2. Background of Related Art

Transformers are extensively used in electrical and electronic appliances. Transformers function to step voltages up or down, to couple signal energy from one stage to another, or for impedance matching. Transformers may also be used in magnetic circuits with solenoids and motor stators.

Transformers typically include a plurality of laminations creating an electrical path around an electric current developed in a winding or other electrical conductor. Conventionally, transformers include two stacks of laminations, one stack which is an E shape and the other stack is an I-shape which closes off the free ends of the E-shaped stack. These E or I-shaped stacks are formed from stacking a given number of properly shaped thin sheets atop one another and secured to one another. Each sheet is typically made from a ferrous material. For example, the sheets forming the stacks of laminations may be riveted together or adhesively assembled using varnish, epoxy resin, or tape, or even held together with spring clips.

Two predominant methods are employed for assembly of the E-shaped stack or laminations to the I-shaped stack of laminations, i.e., either by alternating the core laminations or by welding them together. Welding of the E-I stacks is typically accomplished with expensive machinery operated by highly skilled personnel and consumption of welding products (gas and electrodes). Welding of the stacks of laminations is a relatively expensive undertaking as compared to other methods. Additionally, the welded material interferes with the magnetic performance of the transformer and the welding process causes disruptions in the grain structure of the steel resulting in lower electromagnetic performance.

In order to increase the performance and efficiency of the transformer it is desirable to reduce the gaps of air between adjacent stacks of laminations and/or to increase the contact surface area between the stacks of laminations. Typically, in order to compensate for the gaps of air between the stacks of laminations and to increase the contact surface area between the stacks of laminations, additional sheets of material are added to the stacks of laminations, which, in turn, increase the cost and the size of the transformer.

The need exists for electric transformers, assemblies and the like which are more efficient and less expensive to manufacture as compared to conventional electric transformers.

SUMMARY

The present disclosure relates to electrical transformers and assemblies including the same.

According to an aspect of the present disclosure, a transformer assembly is provided. The transformer assembly includes a first lamination assembly defining a passage therethrough; and a second lamination assembly configured and dimensioned for press-fit engagement in the passage formed in the first lamination assembly.

In an embodiment, the passage of the first lamination assembly includes at least one shaped recess formed into a surface thereof for receiving a complementary tab provided on the second lamination assembly for press-fit engagement therebetween. The second lamination assembly may include a shaped tab extending from a side surface thereof for press-fit engagement with the shaped recess formed in the surface of the passage of the first lamination assembly.

Desirably, the first lamination assembly includes a stack of laminations each defining a central opening and defining the passage of the first lamination assembly when in a stacked condition. A pair of said shaped recesses may be formed in opposite side edges of the central opening of each lamination of the first lamination assembly.

Desirably, the second lamination assembly includes a stack of laminations each including at least one shaped tab extending from a side edge thereof. The second lamination assembly includes a pair of said shaped tabs extending from opposed sides thereof, each tab being configured and dimensioned for press-fit engagement in a respective shaped recess formed in the side edges of the passage formed in the first lamination assembly.

The transformer assembly desirably includes a bobbin defining a central passage configured and dimensioned to selectively receive the second lamination assembly therein. Accordingly, when the second lamination assembly is positioned within the central passage of the bobbin and the shaped tabs thereof extend from opposed sides of the bobbin. The bobbin desirably defines an external race configured and dimensioned to receive an electrical conductor wound therearound.

It is envisioned that the passage of the first lamination assembly is configured and dimensioned to selectively receive the second lamination assembly and the bobbin therein.

The transformer assembly desirably further includes a pair of face-plates positionable against a respective front surface and rear surface of the first lamination assembly. Accordingly, in use, when the second lamination assembly is press-fit into the first lamination assembly, the face-plates cover at least a portion of the first lamination assembly and at least a portion of the second lamination assembly.

Desirably, the tabs of the second lamination assembly include at least one of a trapezoidal, a circular, an arcuate, a rectangular, a triangular, and a saw-toothed shape, and wherein the shaped recess formed in the passage of the first lamination assembly have a complementary shape.

It is envisioned that each lamination of first and second lamination assemblies is formed from a conductive material. It is further envisioned that the bobbin may be formed from an insulative material.

According to another aspect of the present disclosure, a transformer assembly is provided. The transformer assembly includes a first lamination assembly including a stack of laminations. Each lamination of the first lamination assembly includes a central opening formed therein. The central opening includes a pair of shaped recess formed in opposed side edges of the central opening, wherein each lamination of the first lamination assembly is formed from a thin sheet material. Accordingly, when the laminations of the first lamination assembly are configured in a stack, the first lamination assembly defines a central passage. The transformer assembly further includes a second lamination assembly including a stack of laminations. Each lamination of the second lamination assembly includes a pair of shaped tabs extending from opposed side edges thereof. Each lamination of the second lamination assembly is formed from a thin sheet material. Each tab is configured and dimensioned to complement a respective shaped recess formed in the first lamination assembly. The second lamination assembly is press-fittable into the central passage of the first lamination assembly.

Desirably, each lamination of the first lamination assembly has a substantially "O-shape" and each lamination of the second lamination assembly has a substantially "I-shape".

The transformer assembly further includes a bobbin defining a central passage configured and dimensioned to selectively receive the second lamination assembly therein. Accordingly, when the second lamination assembly is positioned within the central passage of the bobbin the shaped tabs thereof extend from opposed sides of the bobbin. The bobbin further defines an external race configured and dimensioned to receive an electrical conductor wound therearound.

Desirably, the passage of the first lamination assembly is configured and dimensioned to selectively receive the second lamination assembly and the bobbin therein.

The transformer assembly may further include a pair of face-plates positionable against a respective front surface and rear surface of the first lamination assembly. Accordingly, when the second lamination assembly is press-fit into the first lamination assembly, the face-plates cover at least a portion of the first lamination assembly and at least a portion of the second lamination assembly.

It is envisioned that the tabs of the second lamination assembly include at least one of a trapezoidal, a circular, an arcuate, a rectangular, a triangular, and a saw-toothed shape, and wherein the shaped recess formed in the passage of the first lamination assembly have a complementary shape.

For a better understanding of the present invention and to show how it may be carried into effect, reference will be made by way of example to the accompanying drawings.

BRIEF DESCRIPTION OF THE DRAWINGS

FIG. 5 is a front elevational view of the transformer assembly of FIG. 1;

FIGS. 6 A-6E are perspective views of alternate ends for the second lamination assembly;

FIG. 10 is a front elevational view of the transformer assembly of FIG. 1 including another second lamination assembly, in accordance with an embodiment of the present disclosure.

DETAILED DESCRIPTION OF THE EMBODIMENTS

Figure 1:
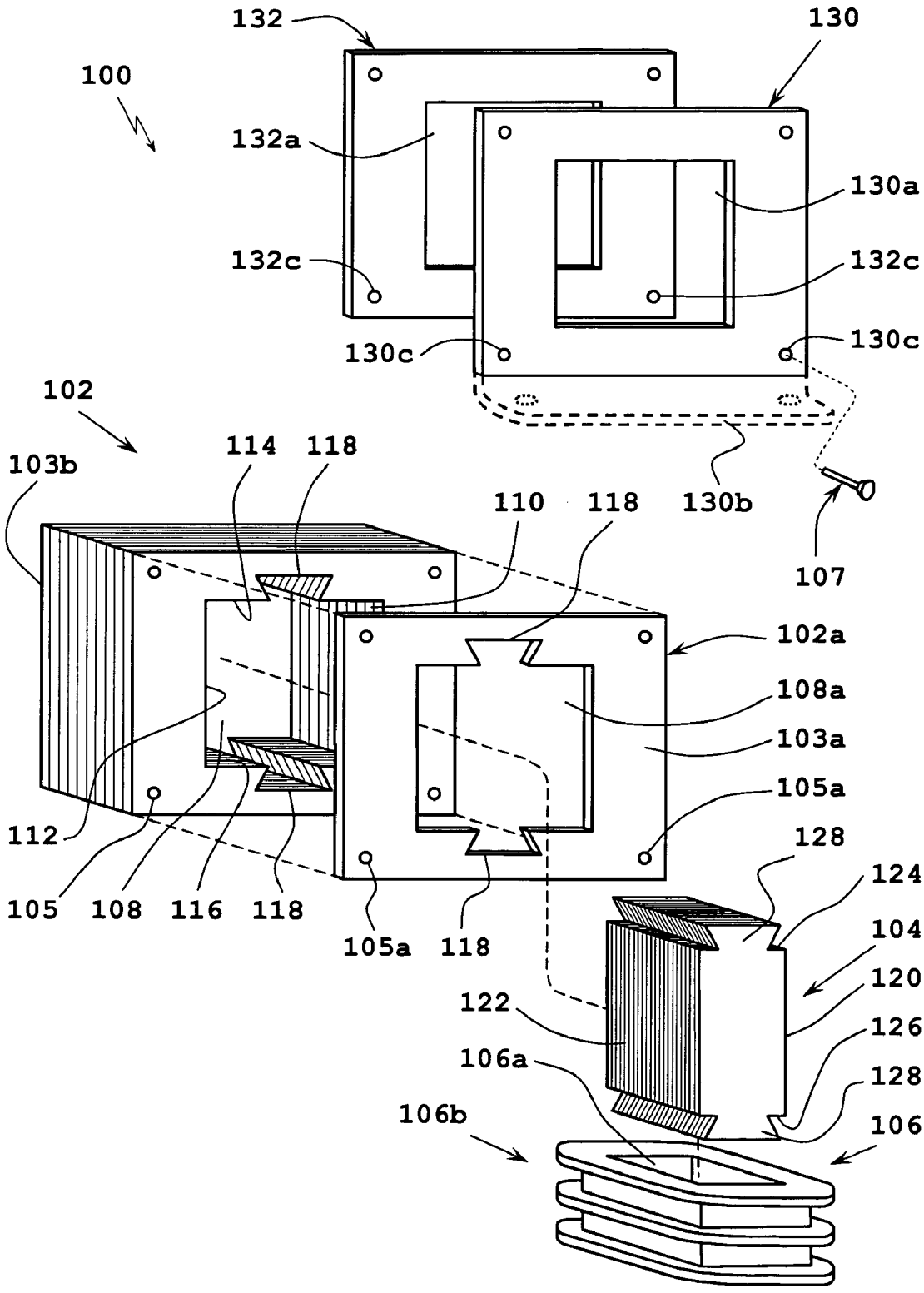
FIG. 1 is a perspective view of a transformer assembly, with parts separated, in accordance with an embodiment of the present disclosure.

Embodiments of the presently disclosed electric transformer assembly will now be described in detail with reference to the drawing figures wherein like reference numerals identify similar or identical elements. As used herein and as is traditional, the term "distal" refers to that portion which is furthest from the user while the term "proximal" refers to that portion which is closest to the user. In addition, terms such as "above", "below", "forward", "rearward", etc. refer to the orientation of the figures or the direction of components and are simply used for convenience of description.

Referring initially to FIGS. 1-5, a transformer assembly, in accordance with an embodiment of the present disclosure, is generally designated as 100. Transformer assembly 100 includes at least a first lamination assembly 102, a second lamination assembly 104, and a bobbin 106. Each lamination assembly 102, 104 includes a stack of laminations. Each stack of laminations for each lamination assembly 102, 104 desirably includes the same number of laminations, e.g., 102*a*. Each lamination assembly 102, 104 is desirably fabricated from a plurality of thin sheets of ferrous material, usually steel, defining the stack of laminations. In some instances, lamination assemblies 102, 104 may be fabricated from different materials in order to develop particular magnetic characteristics.

Each sheet of lamination making up first lamination assembly 102 is generally "O-shaped", defining a central opening 108*a*. When the sheets of laminations are stacked together, central opening 108*a* defines a central passage 108 having a substantially rectangular configuration. Central passage 108 of first lamination assembly 102 includes a right side surface 110, a left side surface 112, an upper surface 114, and a lower surface 116.

Figure 2:
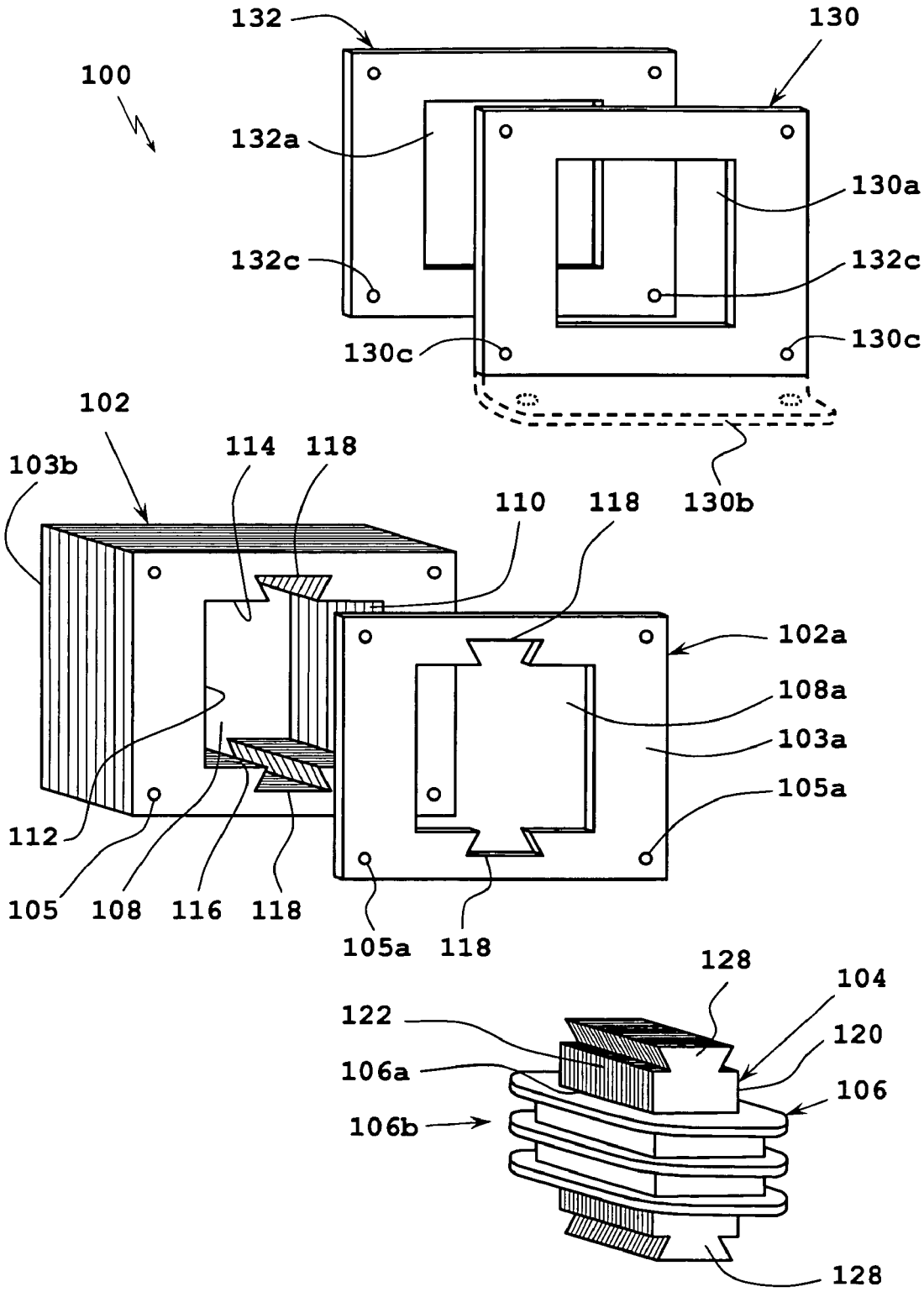
FIG. 2 is a perspective view of the transformer assembly of FIG. 1, illustrating a second lamination assembly inserted into a bobbin.

In accordance with the present disclosure, a shaped recess 118 is formed into upper surface 114 and/or lower surface 116 of passage 108 of first lamination assembly 102. Preferably, a shaped recess 118 is formed in each of upper surface 114 and lower surface 116 of passage 108 of first lamination assembly 102. As seen in FIG. 2, each recess 118 is in the shape of a "keystone" or is substantially trapezoidal in shape.

Each sheet of lamination making up second lamination assembly 104 is generally "I-shaped". Second lamination assembly 104 includes a right side surface 120, a left side surface 122, an upper surface 124, and a lower surface 126. In accordance with the present disclosure, a shaped tab or tongue 128 extends from upper surface 124 and/or lower surface 126 of second lamination assembly 104. Preferably, tab 128 is formed in each of upper surface 124 and lower surface 116 of second lamination assembly 104. As seen in FIG. 1 each tab 128 is shaped and dimensioned to complement a respective recess 118 formed in each of upper surface 114 and lower surface 116 of passage 108 of first lamination assembly 102.

Second lamination assembly 104 is sized for insertion into central passage 108 of first lamination assembly 102, as will be discussed in greater detail below. Additionally, each tab 128 of second lamination assembly 104 is sized for tight friction fitting within respective recesses 118 formed in each of upper surface 114 and lower surface 116 of passage 108 of first lamination assembly 102.

Bobbin 106 defines a central passage 106*a* extending therethrough and two races or perimetral channels 106*b* extending therearound. Bobbin 106 is configured and dimensioned for selective insertion into central passage 108 of first lamination assembly 102. Central passage 106*a* of bobbin 106 is configured and dimensioned to selectively receive second lamination assembly 104 therein. Races 106*b* of bobbin 106 is configured and dimensioned to receive electrical conductors "E" (see FIG. 3) wound therearound and therein to form top and bottom electrical coils. Bobbin 106 is desirably fabricated from a conventional insulating material, such as, for example, plastic and the like.

As seen in FIG. 1, transformer assembly 100 may further include at least a front or first face plate 130 configured and dimensioned for placement over a front surface 103*a* of first lamination assembly 102, and desirably, over at least a portion of second lamination assembly 104 when second lamination assembly 104 is positioned within central aperture 108 of first lamination assembly 102. Desirably, transformer assembly 100 further includes a rear or second face plate 132 configured and dimensioned for placement over a rear surface 103*b* of first lamination assembly 102, and desirably, over at least a portion of second lamination assembly 104 when second lamination assembly 104 is positioned within central aperture 108 of first lamination assembly 102. Each face plate 130, 132 includes a respective window 130*a*, 132*a* formed therein and dimensioned to allow at least a portion of bobbin 106 to extend or project therethrough.

In an embodiment, it is envisioned that each face plate 130, 132 includes a foot or bracket 130*b*, 132*b* (shown in phantom in FIGS. 1-4) extending from an edge thereof, preferably, a lower edge thereof. Brackets 130*b*, 132*b* enable mounting of transformer assembly 100 to various surfaces and the like. Even though foot or bracket 130*b*, 132*b* are shown in the figures as being provided along two lower edges, foot or bracket 130*b*, 132*b* can be provided along any of the four edges.

While face plates 130, 132 each defining a window 130*a*, 132*a*, respectively, are shown, it is envisioned that any configuration face plate capable of covering at least a portion of first lamination assembly 102 and at least a portion of second lamination assembly 104, so that first lamination assembly 102 and second lamination assembly 104 do not become separated may be used. For example, the face plate may simply be a band extending across at least a portion of first lamination assembly 102 and at least a portion of second lamination assembly 104.

As seen in FIGS. 1-4, each lamination 102*a* can include at least one assembly-hole 105*a* formed therein and defining an assembly-passage 105 extending entirely through first lamination assembly 102 when laminations 102*a* are stacked together. Additionally, each face plate 130, 132 includes assembly-holes 130*c*, 132*c* formed therein and aligning or registering with assembly-passages 105 when face plates 130, 132 are properly placed against surfaces 103*a*, 103*b* of first lamination assembly 102. A rivet, screw or other fastening member 107 is used to secure each lamination 102*a* together to form first lamination assembly 102 and to secure face plates 130, 132 to first lamination assembly 102.

It is contemplated that laminations 102*a* can be stacked together and held or joined together by applying tape to the outer edges of the first lamination assembly 102. It is also contemplated that laminations 102*a* can be stacked together and held or joined together by applying a band or belt around the first lamination assembly 102. The band or belt is preferably formed by providing a shrink tube and heating the shrink tube to cause it to shrink and tighten around the first lamination assembly 102. If these two methods are used to join together the laminations 102*a*, holes 105*a* and 130*c*, as well as fastening members 107 are not required.

It is further contemplated that laminations 102*a* can be stacked together by forming at least one protrusion or embosement on each lamination 102*a*. The protrusion will provide an indent on the opposite side. During stacking, a protrusion from each lamination 102*a* mates with an indent formed on another lamination 102*a* and so on for stacking all the laminations 102*a* to form the first lamination assembly 102.

With continued reference to FIGS. 1-4, a discussion of the assembly of transformer assembly 100 is provided. As seen in FIGS. 1 and 2, second lamination assembly 104 is inserted into central passage 106*a* of bobbin 106. Desirably, second lamination assembly 104 and bobbin 106 are configured and dimensioned such that tabs 128 of second lamination assembly 104 extend from either end of central passage 106*a* of bobbin 106.

Desirably, either prior to or after insertion of second lamination assembly 104 into central passage 106*a* of bobbin 106, an electrical conductor "E" (see FIG. 3) is wrapped around and within race 106*b* of bobbin 106.

Figure 3:
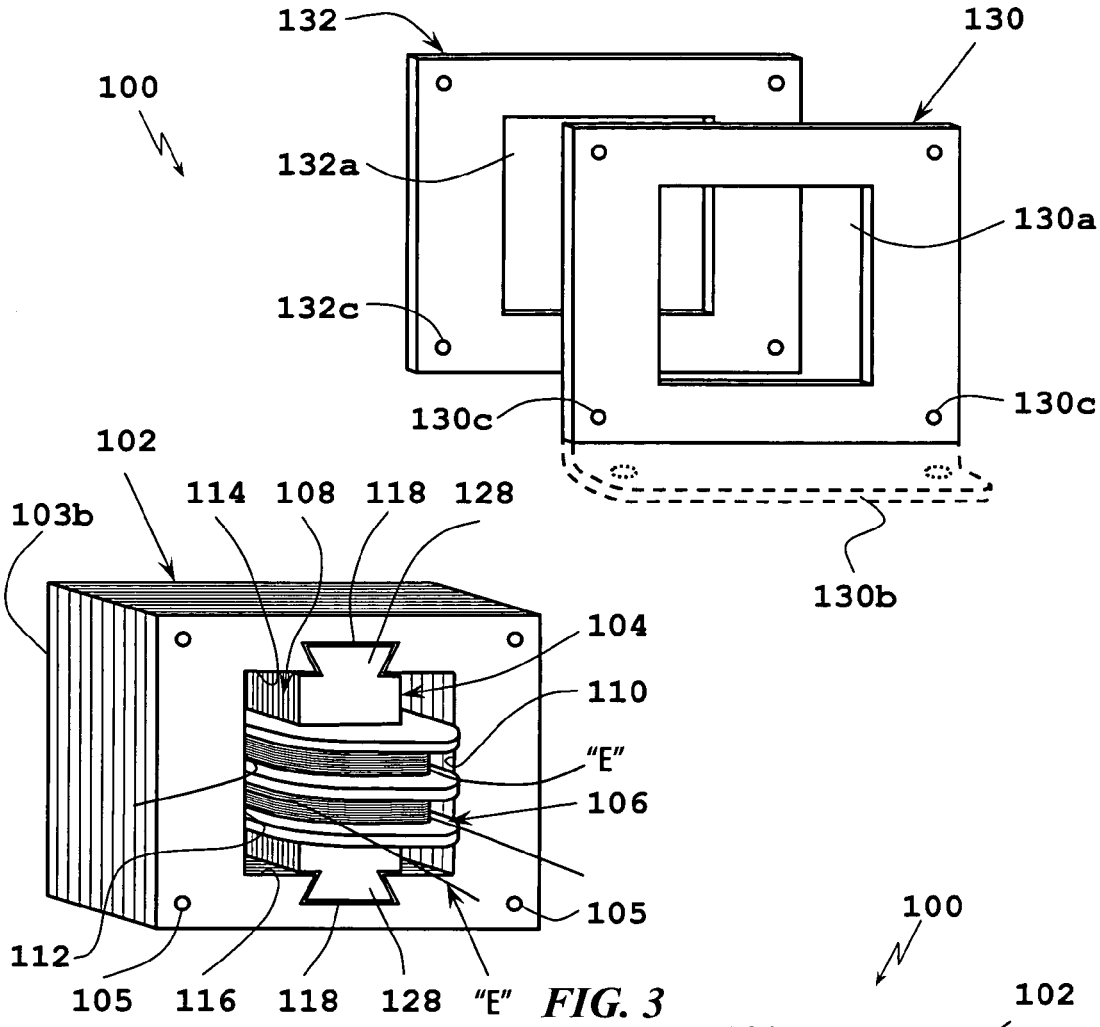
FIG. 3 is a perspective view of the transformer assembly of FIG. 1, illustrating the second lamination assembly and bobbin inserted into the first lamination assembly.

As seen in FIGS. 2 and 3, with second lamination assembly 104 inserted into central passage 106*a* of bobbin 106, both second lamination assembly 104 and bobbin 106 are inserted into central passage 108 of first lamination assembly 102. In particular, each tab 128 of second lamination assembly 104 is aligned with a respective complementary shaped recess 118 formed in upper surface 114 and lower surface 116 of passage 108 of first lamination assembly 102. In effect, second lamination assembly 104 is press-fit or slide-fit into central passage 108 of first lamination assembly 102.

Figure 4:
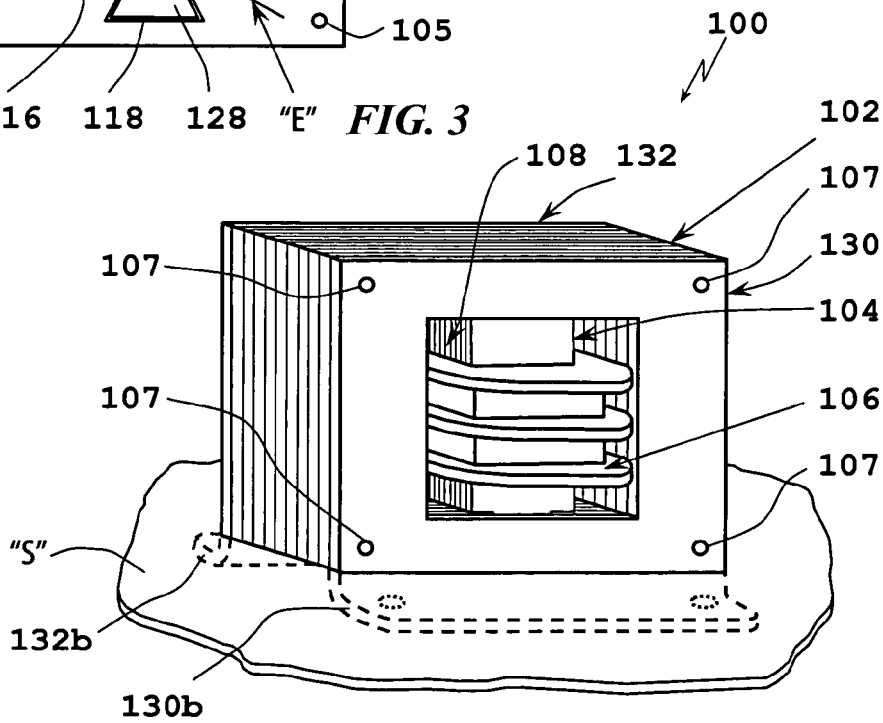
FIG. 4 is a perspective view of the transformer assembly of FIG. 1, illustrating the application of face plates onto the front and rear surfaces of the first lamination assembly to retain the second lamination assembly and the bobbin therewithin.

As seen in FIGS. 3 and 4, with second lamination assembly 104 press fit into central passage 108 of first lamination assembly 102, face plates 130, 132 are placed against front surface 103*a* and rear surface 103*b* of first lamination assembly 102. As mentioned above, face plates 130, 132 extend across at least a portion of first lamination assembly 102 and at least a portion of second lamination assembly 104 in such a manner that second lamination assembly 104 is retained within central passage 108 of first lamination assembly 102. In particular, face plates 130, 132 are configured and dimensioned to extend across at least a portion of first lamination assembly 102 and tabs 128 of second lamination assembly 104.

Face plates 130, 132 are secured to and against first lamination assembly with rivets 107. Additionally, as seen in FIG. 4, brackets 130*b*, 132*b* may be used to secure transformer assembly 100 to a surface "S" or the like.

Turning now to FIGS. 6A-6E, alternate embodiments of second lamination assembly 104 are shown. As seen in FIG. 6A, second lamination assembly 104 includes a substantially cylindrically shaped tab 128*a* extending from an upper surface 124 and a lower surface thereof. Cylindrical tab 128*a* is formed upon stacking of a plurality of laminations each having a substantially circular tab extending from an upper edge and a lower edge thereof. As seen in FIG. 6B, each lamination of second lamination assembly 104 includes an arcuate or convex tab 128*b* extending from an upper edge 124 and a lower edge thereof. As seen in FIG. 6C, each lamination of second lamination assembly 104 includes a rectangular tab 128*c* extending from an upper edge 124 and a lower edge thereof. As seen in FIG. 6D, each lamination of second lamination assembly 104 includes a triangular tab 128*d* extending from an upper edge 124 and a lower edge thereof. As seen in FIG. 6E, each lamination of second lamination assembly 104 includes a plurality of triangular tabs 128*e* extending from an upper edge 124 and a lower edge thereof.

Figure 7B:
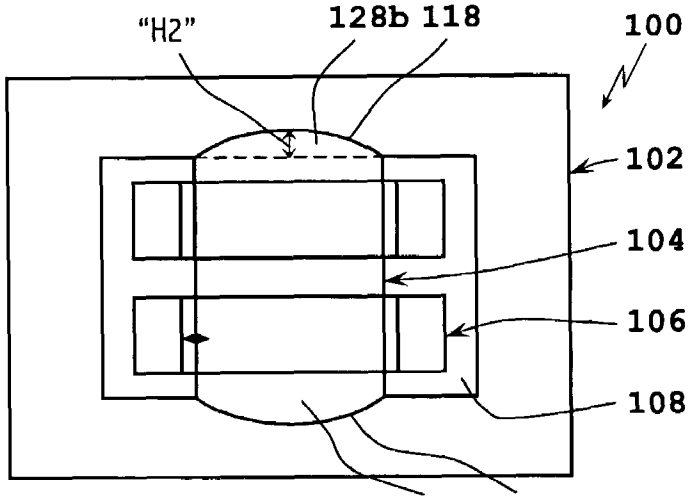
FIG. 7B is a front elevational view of the transformer assembly of FIG. 1 including a second lamination assembly as seen in FIG. 6B.
Figure 7A:
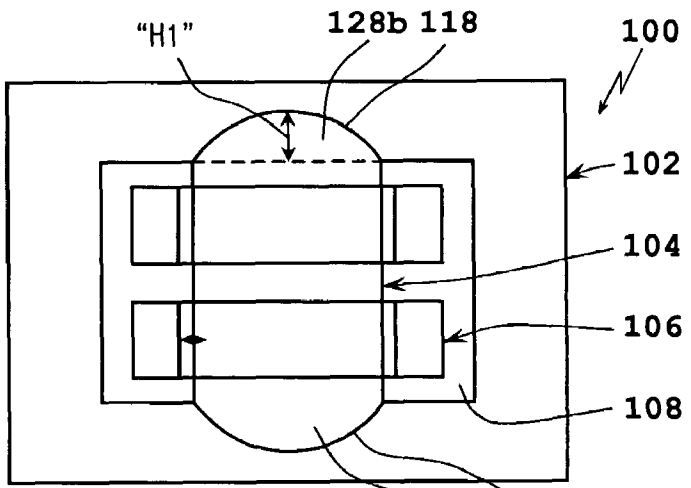
FIG. 7A is a front elevational view of the transformer assembly of FIG. 1 including a second lamination assembly as seen in FIG. 6B.

Turning now to FIGS. 7A and 7B, front elevational views of transformer assemblies 100 including second lamination assemblies 104 having arcuate or convex tabs 128*b* (as shown in FIG. 6B) are shown. As seen in FIG. 7A, arcuate tab 128*b* of each lamination of second lamination assembly 104 has a relatively smaller radius of curvature. As seen in FIG. 7B, arcuate tab 128*b* of each lamination of second lamination assembly 104 has a relatively larger radius of curvature. Additionally, as seen in FIGS. 7A and 7B, tab 128*b* of FIG. 7A may have a height "H1" which is relatively larger or higher than height "H2" of tab 128*b* of FIG. 7B.

Figure 8A:
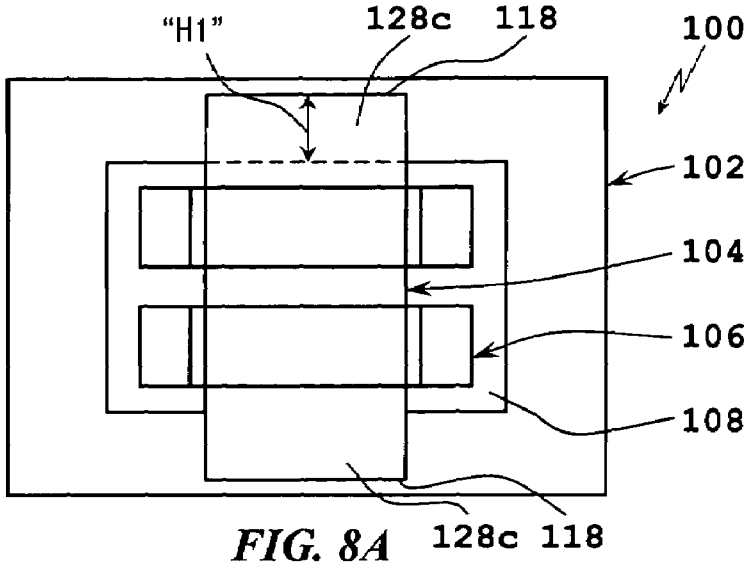
FIG. 8A is a front elevational view of the transformer assembly of FIG. 1 including a second lamination assembly as seen in FIG. 6C.
Figure 8B:
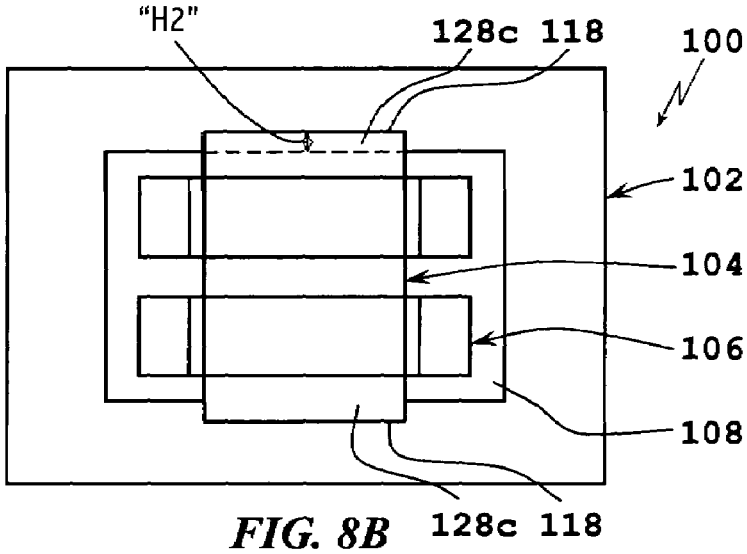
FIG. 8B is a front elevational view of the transformer assembly of FIG. 1 including a second lamination assembly as seen in FIG. 6C.
Figure 8C:
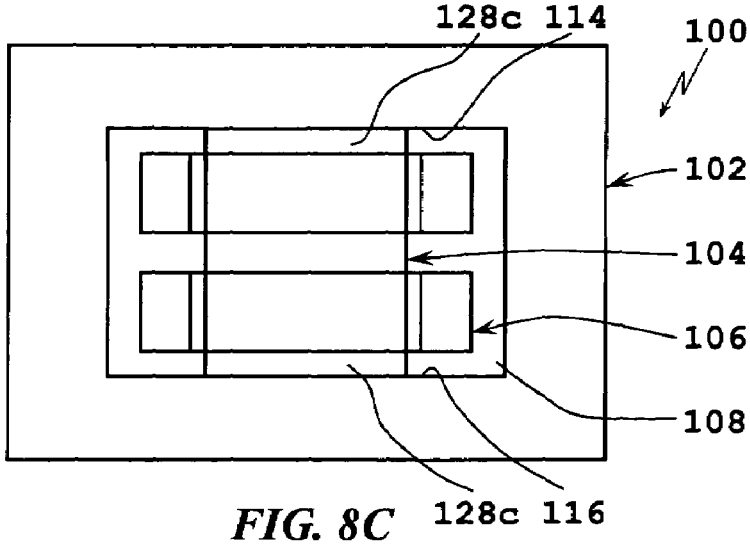
FIG. 8C is a front elevational view of the transformer assembly of FIG. 1 including a second lamination assembly as seen in FIG. 6C.

Turning now to FIGS. 8A-8C, front elevational views of transformer assemblies 100 including second lamination assemblies 104 having rectangular tabs 128*c* (as shown in FIG. 6C) are shown. As seen in FIG. 8A, rectangular tab 128*c* of each lamination of second lamination assembly 104 has a relatively larger height "H1". As seen in FIG. 8B, rectangular tab 128*c* of each lamination of second lamination assembly 104 has a relatively smaller height "H2", i.e., is shallower. As seen in FIG. 8C, rectangular tab 128*c* of each lamination of second lamination assembly 104 has no height, i.e., top and bottom surfaces 124, 126, respectively, are press fitted against upper surface 114 and lower surface 116 of central passage 108 of first lamination assembly 102.

Figure 9B:
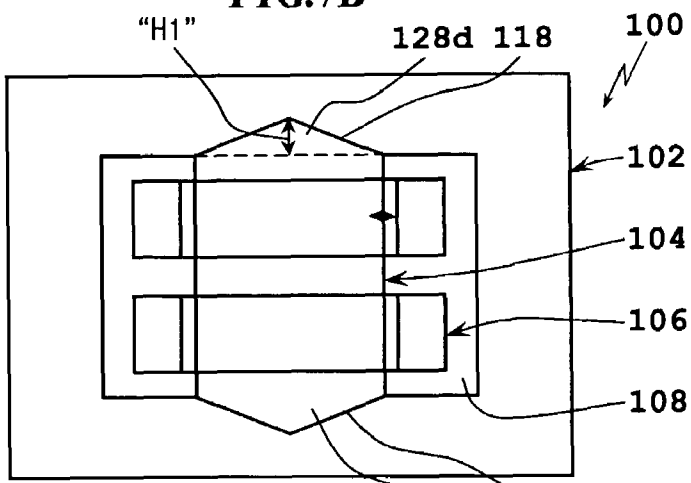
FIG. 9B is a front elevational view of the transformer assembly of FIG. 1 including an alternate second lamination assembly, in accordance with an embodiment of the present disclosure.
Figure 9A:
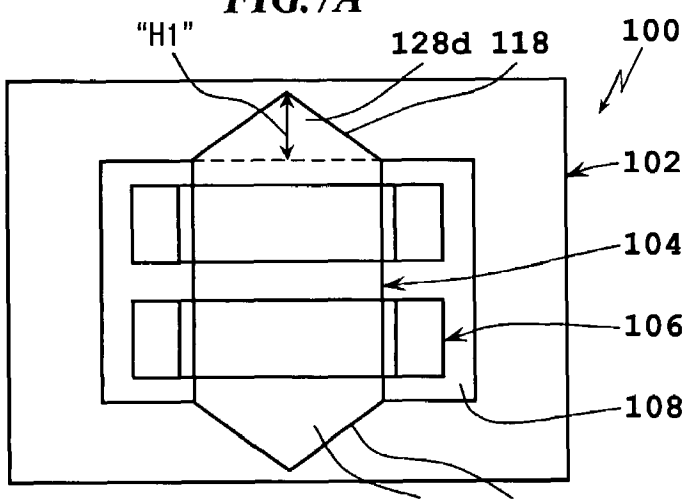
FIG. 9A is a front elevational view of the transformer assembly of FIG. 1 including an alternate second lamination assembly, in accordance with an embodiment of the present disclosure.

Turning now to FIGS. 9A and 9B, front elevational views of transformer assemblies 100 including second lamination assemblies 104 having triangular tabs 128*d* (as shown in FIG. 6D) are shown. As seen in FIG. 9A, triangular tab 128*d* of each lamination of second lamination assembly 104 has a relatively larger height "H1". As seen in FIG. 9B, triangular tab 128*d* of each lamination of second lamination assembly 104 has a relatively smaller height "H2", i.e., is shallower.

Turning now to FIG. 10, a front elevational view of a transformer assembly 100 including second lamination assemblies 104 having a plurality of triangular tabs 128*e* (as shown in FIG. 6E) is shown. In other words, the plurality of triangular tabs 128*e* defines a saw-toothed shape or pattern.

It is envisioned and within the scope of the present disclosure that tabs 128 of second lamination assemblies 104 may be any single shape or combination of shapes and/or each second lamination assembly 104 may include tabs 128 of differing shapes from one another. Accordingly, it is understood that the shapes of recesses 118 formed in passage 108 of first lamination assembly 102 are configured and dimensioned to complement the particular shape of tabs 128 of second lamination assembly 104.

By press fitting second lamination assembly 104 into central passage 108 of first lamination assembly 102, using tabs 128 of second lamination assembly 104 inserted into complementary shaped recesses 118 of first lamination assembly 102, the surface area in contact between the first and second lamination assemblies 102, 104 is increased and thus the magnetic conductivity between the first and second lamination assemblies is also increased. Additionally, since second lamination assembly 104 is press fit into central passage 108 of first lamination assembly 102, the need to weld the two components together is eliminated and thus the creation of grain structure disruption, which interferes with magnetic performance, is reduced.

Transformer assemblies constructed in accordance with the present disclosure may be constructed more efficiently and less expensively than traditional transformer assemblies. Additionally, transformer assemblies constructed in accordance with the present disclosure eliminate the need for the laminations to be welded together, eliminate the need to post varnish the transformer to protect the bear areas of the steel created by the welding operation, and possibly eliminate the need to use epoxies which are used to bond the joints between the first and second lamination assemblies 102, 104 together.

Desirably, since welding of the joints between the first and second lamination assemblies 102, 104 is eliminated, first and second lamination assemblies 102, 104 may be fabricated from coated steel laminations which provide better protection against rust. Transformer assemblies constructed in accordance with the present disclosure also reduce the number of joints from three (3) joints, which currently exist for transformer assemblies including an "E-shaped" lamination assembly and an "I-shaped" lamination assembly, to two (2) joints for the "O-shaped" lamination assembly and "I-shaped" lamination assembly.

It is to be understood that the foregoing description is merely a disclosure of particular embodiments and is no way intended to limit the scope of the invention. Other possible modifications will be apparent to those skilled in the art and all modifications are to be defined by the following claims.

What is claimed is:

1. A transformer assembly comprising:

a first lamination assembly having a first shape and defining a passage therethrough;

a second lamination assembly having a second shape and configured and dimensioned for being fully embedded within the passage formed in the first lamination assembly;

a bobbin defining a central passage configured and dimensioned to selectively receive the second lamination assembly therein, wherein the passage of the first lamination assembly is configured and dimensioned to selectively receive the second lamination assembly and the bobbin therein;

at least one face plate overlying substantially a major portion of the front surface of the first lamination assembly and at least a portion of the second lamination assembly, when the second lamination assembly is fully embedded within the passage of the first lamination assembly, for maintaining the second lamination assembly within the passage of the first lamination assembly;

wherein the first shape is geometrically different than the second shape;

wherein a portion of the second lamination assembly contacts a portion of the passage formed in the first lamination assembly; and at least one conduit passing through the passage of the first lamination assembly and located between the embedded second lamination assembly, the bobbin and the first lamination assembly.

2. The transformer assembly according to claim 1, wherein the passage of the first lamination assembly includes at least one shaped recess formed into a surface thereof for receiving a complementary tab provided on the second lamination assembly for press-fit engagement therebetween.

3. The transformer assembly according to claim 2, wherein the second lamination assembly includes a shaped tab extending from a side surface thereof for press-fit engagement with the shaped recess formed in the surface of the passage of the first lamination assembly.

4. The transformer assembly according to claim 3, wherein the first lamination assembly includes a stack of laminations each defining a central opening and defining the passage of the first lamination assembly when in a stacked condition.

5. The transformer assembly according to claim 4, wherein a pair of said shaped recesses is formed in opposite side edges of the central opening of each lamination of the first lamination assembly.

6. The transformer assembly according to claim 5, wherein the second lamination assembly includes a stack of laminations, and wherein each lamination includes at least one of said shaped tab extending from a side edge thereof.

7. The transformer assembly according to claim 6, wherein the second lamination assembly includes a pair of said shaped tabs extending from opposed sides thereof, each tab being configured and dimensioned for being received in a respective shaped recess formed in the side edges of the passage formed in the first lamination assembly.

8. The transformer assembly according to claim 7, wherein when the second lamination assembly is positioned within the central passage of the bobbin the shaped tabs thereof extend from opposed sides of the bobbin.

9. The transformer assembly according to claim 8, wherein the bobbin defines an external race configured and dimensioned to receive an electrical conductor wound therearound.

10. The transformer assembly according to claim 1, wherein the at least one conduit includes at least two conduits which are symmetrical with respect to an axis of at least one of the first lamination assembly and the second lamination assembly.

11. The transformer assembly according to claim 9, further comprising a pair of face-plates positionable against a respective front surface and rear surface of the first lamination assembly, wherein the second lamination assembly is received in the first lamination assembly.

12. The transformer assembly according to claim 11, wherein the tabs of the second lamination assembly include at least one of a trapezoidal, a circular, an arcuate, a rectangular, a triangular, and a saw-toothed shape, and wherein the shaped recess formed in the passage of the first lamination assembly has a complementary shape.

13. The transformer assembly according to claim 12, wherein each lamination of first and second lamination assemblies is formed from a conductive material.

14. The transformer assembly according to claim 13, wherein the bobbin is formed from an insulative material.

15. A transformer assembly comprising:

a first lamination assembly having a first shape and including a stack of laminations, each lamination of the first lamination assembly including:

a central opening formed therein, the central opening including a pair of shaped recesses formed in opposed side edges of the central opening, wherein when the laminations of the first lamination assembly are configured in a stack, the first lamination assembly defines a central passage;

a second lamination assembly having a second shape and including a stack of laminations, each lamination of the second lamination assembly including:

a pair of shaped tabs extending from opposed side edges thereof, wherein each tab is configured and dimensioned to complement a respective shaped recess formed in the first lamination assembly; wherein the second lamination assembly is fully embedded into the central passage of the first lamination assembly;

a bobbin defining a central passage configured and dimensioned to selectively receive the second lamination assembly therein, wherein the passage of the first lamination assembly is configured and dimensioned to selectively receive the second lamination assembly and the bobbin therein;

at least one face plate overlying substantially a major portion of the front surface of the first lamination assembly and at least the pair of tabs of the second lamination assembly, when the second lamination assembly is fully embedded within the passage of the first lamination assembly, for maintaining the second lamination assembly within the passage of the first lamination assembly;

wherein the first shape is geometrically different than the second shape;

wherein a portion of the second lamination assembly contacts a portion of the passage formed in the first lamination assembly; and at least one conduit passing through the passage of the first lamination assembly and located between the embedded second lamination assembly, the bobbin and the first lamination assembly.

16. The transformer assembly according to claim 15, wherein each lamination of the first lamination assembly has a substantially "O-shape" and each lamination of the second lamination assembly has a substantially "I-shape".

17. The transformer assembly according to claim 16, wherein when the second lamination assembly is positioned within the central passage of the bobbin the shaped tabs thereof extend from opposed sides of the bobbin, the bobbin defining an external race configured and dimensioned to receive an electrical conductor wound therearound.

18. The transformer assembly according to claim 15, wherein the at least one conduit includes at least two conduits which are symmetrical with respect to an axis of at least one of the first lamination assembly and the second lamination assembly.

19. The transformer assembly according to claim 18, further comprising a pair of face-plates positionable against a respective front surface and rear surface of the first lamination assembly, wherein when the second lamination assembly is received in the first lamination assembly.

20. The transformer assembly according to claim 19, wherein the tabs of the second lamination assembly include at least one of a trapezoidal, a circular, an arcuate, a rectangular, a triangular, and a saw-toothed shape, and wherein the shaped recess formed in the passage of the first lamination assembly has a complementary shape.

* * * * *